US005847320A

United States Patent [19]

Fisher

[11] Patent Number: 5,847,320

[45] Date of Patent: Dec. 8, 1998

[54] SOLDERLESS WIRE SPLICING DEVICE AND METHOD

[76] Inventor: Ivan B. Fisher, 6200 Falls Cir. Dr. Apt. 101, Lauderhill, Fla. 33319

[21] Appl. No.: 941,249

[22] Filed: Sep. 30, 1997

[51] Int. Cl.[6] ..... H01R 11/00

[52] U.S. Cl. ..... 174/87

[58] Field of Search ..... 174/84 R, 87; 403/214, 268, 270; 439/433, 840

[56] References Cited

U.S. PATENT DOCUMENTS

| | | | |
|---|---|---|---|
| 1,736,379 | 11/1929 | Sommer | 174/87 |
| 2,906,810 | 9/1959 | D'Ascoli | 174/87 |
| 3,350,499 | 10/1967 | Swanson | 174/87 |
| 3,739,470 | 6/1973 | Eppler | 174/87 X |
| 4,086,427 | 4/1978 | Nasuta, Jr. et al. | 174/88 C |
| 4,446,332 | 5/1984 | Dauser, Jr. | 174/87 |
| 4,454,376 | 6/1984 | Holder | 174/87 |
| 4,687,273 | 8/1987 | Pranch | 439/411 |
| 5,083,935 | 1/1992 | Herman | 439/433 |
| 5,099,089 | 3/1992 | Zan | 174/87 |
| 5,531,618 | 7/1996 | Marker | 439/840 |

*Primary Examiner*—Kristine Kincaid
*Assistant Examiner*—Chau N. Nguyen
*Attorney, Agent, or Firm*—Alvin S. Blum

[57] ABSTRACT

A solderless connecting and splicing device and method employs a wire nut with a conductive element inside a rigid insulator. The conductive element has a frusto-conical passage with a tapered internal thread. Instead of twisting conductors together and inserting them directly into the wire nut, this invention provides a tube assembly of a number of conductive tubular elements joined together in parallel. A conductor is inserted into each element and the assembly inserted into the wire nut. The nut is then twisted. As the assembly is drawn into the smaller end of the passage the tubular elements collapse and crimp against the conductors to form a low resistance splice.

13 Claims, 2 Drawing Sheets

SOLDERLESS WIRE SPLICING DEVICE AND METHOD

FIELD OF THE INVENTION

This invention relates to devices and methods for electrically joining conductive wires together and more particularly to solderless connections including a wire lock or nut in which the wires are not twisted together.

BACKGROUND OF THE INVENTION

Electrical conductors were joined by stripping the ends of insulation, scraping them clean, twisting the ends together, and applying solder to electrically join the ends together. If insufficient heat or flux were provided, or the wires not properly cleaned, a high resistance or "cold soldered" joint resulted. To overcome these problems, the "wire nut" solderless connectors were introduced. These comprise a plastic outer shell and an inner electrically conductive inner tapered cylinder with a sharp screw thread. To apply this connector, the bare ends of the conductors are pointed in the same direction, twisted together and inserted into the wide end of the wire nut. Twisting the wire nut crimps the conductors together as the tapered thread advances on the wires and cuts into the conductors to electrically join the conductors.

Problems arise with use of wire nuts when heavy conductors are to be joined and when more than two conductors are to be joined. The joint becomes bulky and it is difficult to arrange for all of the conductors to be exposed to the screw thread. If all of the conductors are not joined by a low resistance connection, the joint may lower the voltage in the line and heat up to the point of causing a fire. A wire nut remains a quick and convenient splicing method but it would be greatly enhanced by means to overcome the difficulties associated with their use on heavy and multiple conductors.

SUMMARY OF THE INVENTION

It is accordingly an object of the invention to provide means to enhance the use of wire nuts with multiple conductors and large conductors that would hold the conductors in place while the wire nut is being applied. It is another object that the apparatus and method eliminate the need to twist the conductors together before applying the wire nut. It is yet another object that the apparatus and method ensure that all conductors present equal surfaces to the tapered screw thread of the wire nut.

These and other objects, advantages and features of the invention will become apparent when the detailed description is studied in conjunction with the drawings, in which like reference characters designate like elements in the various drawing figures.

DETAILED DESCRIPTION OF PREFERRED EMBODIMENTS

Figure 1:
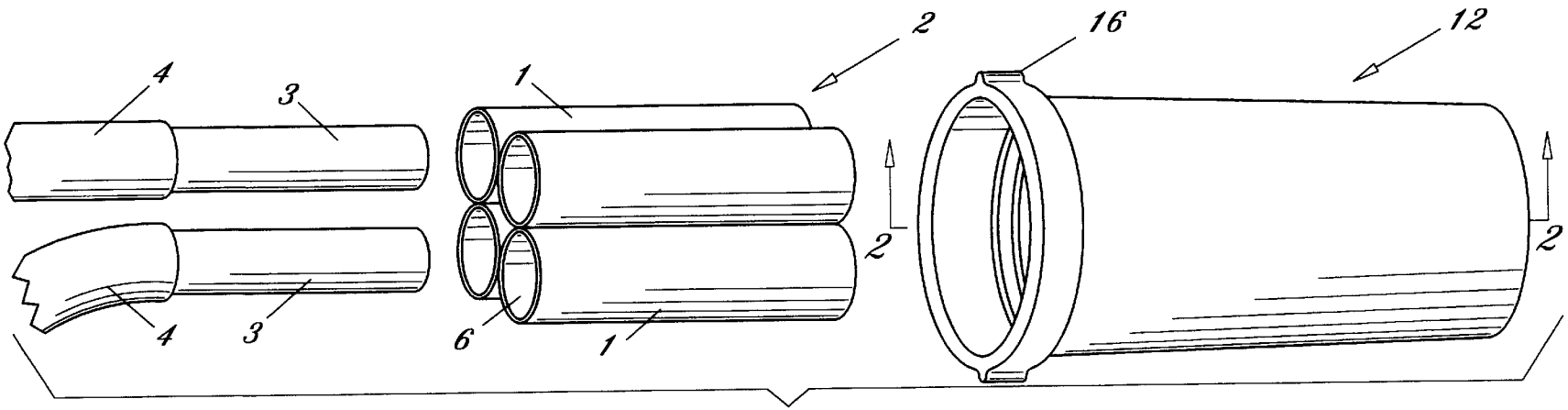
FIG. 1 is a perspective view of the invention in combination with elements used with the invention.
Figure 2:
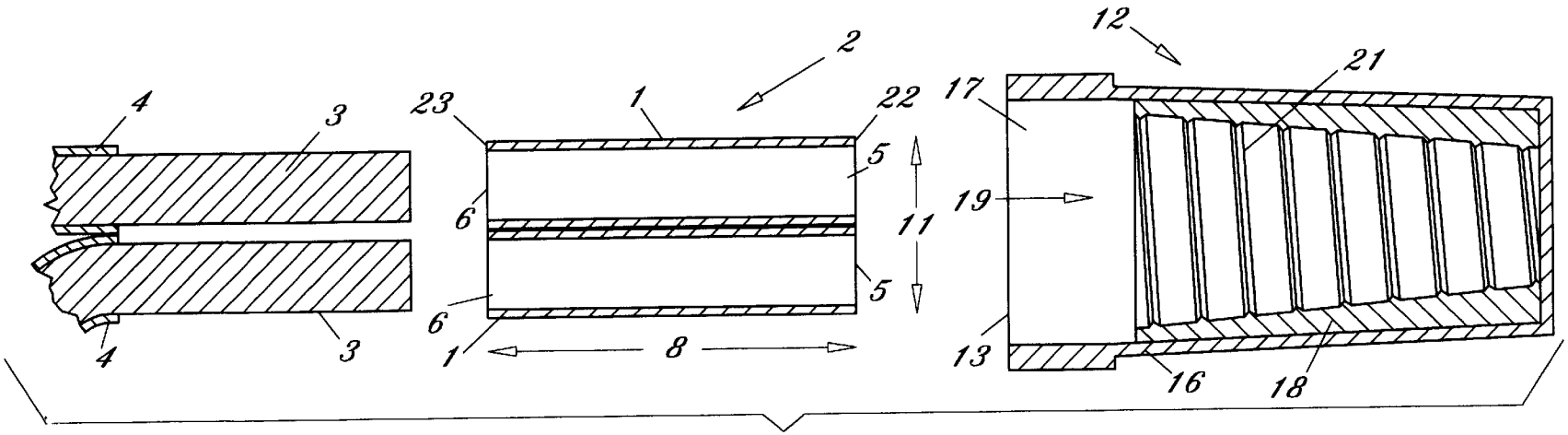
FIG. 2 is a sectional view taken through line 2—2 of FIG. 1.
Figure 3:
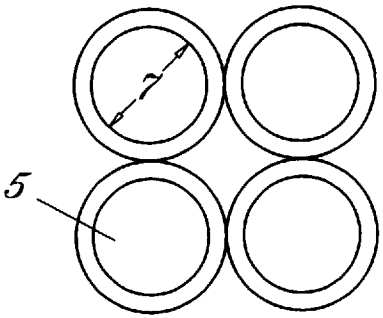
FIG. 3 is an end view of the tube assembly of FIG. 1.

Referring now first to FIGS. 1–3, a tube assembly 2 is comprised of four thin-wall copper-containing metal tubular elements 1 that have been brazed or soldered together. The elements 1 have parallel axial bores 5. Each tubular element 1 has an inside diameter 7 dimensioned for ready entry of conductor 3 from which the insulation 4 has been stripped. The tubular element has a length 8 at least four times the inside diameter and preferably substantially equal to that of the frusto-conical inner passage 19 of the conductive member 18 inside the bore 17 of the insulator 16 of the wire nut 12. The passage is provided with a tapered internal screw thread 21 that acts as a metal working surface.

To electrically join the ends of four insulated wires in a low resistance splice, the insulation 4 is stripped from the ends of the conductors 3. The bare conductors 3 are inserted into the open ends 6 of the elements 1, one in each element. The second edge 22 of assembly 2 opposite first edge 23 is then inserted through the open end 13 of wire nut 12 into the large diameter end 20 of passage 19, until the outside diameter 11 of the assembly engages the internal thread. The wire nut is then rotated relative to the conductors. The screw thread cuts into the elements 1 guiding and drawing the assembly into the tapered passage, compressing the elements 1 and crimping the conductors against the elements to lock the conductors together in a stable low resistance connection or splice.

Figure 4:
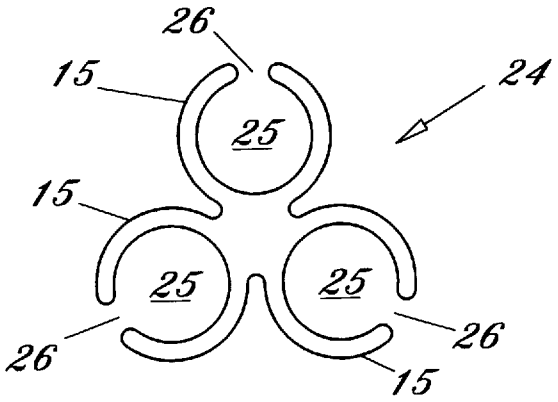
FIG. 4 is an end view of another embodiment of the invention.

Referring now to FIG. 4, an extruded conductive metal tubular assembly 24 with three axial bores or elements is shown, each element 25 is provided with a slot 26 extending from the bore thru to the outer surface 15. This construction may facilitate the collapsing and crimping of the elements onto the conductors.

Figure 5:
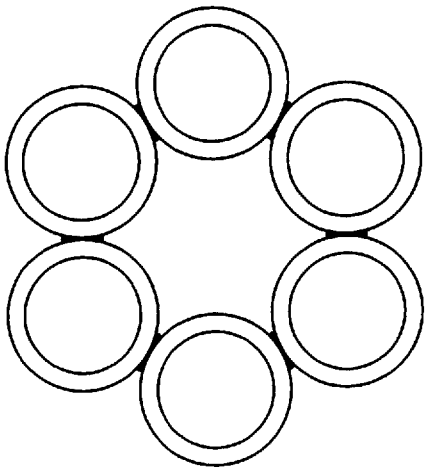
FIG. 5 is an end view of another embodiment of the invention.

FIG. 5 shows a tube assembly with six tubular elements.

Figure 6:
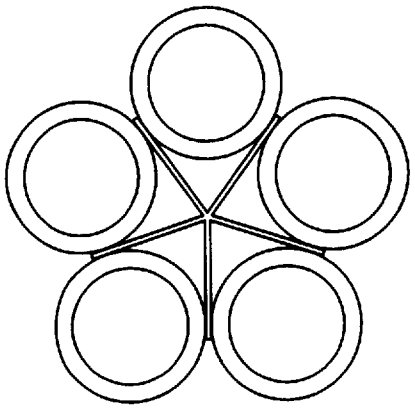
FIG. 6 is an end view of another embodiment of the invention.

FIG. 6 shows a tube assembly with five tubular elements.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A tube assembly for conductively joining together a plurality of conductors using a wire nut that has a rigid insulator structure having a channel defined therein and an open end and a conductive member received within the channel, the conductive member having a frusto-conical passage therein with a larger diameter of the passage facing the open end of the channel, the passage being provided with a tapered internal thread that has a smaller diameter facing the closed end, the tube assembly comprising:

a plurality of electrically conductive, crimpable tubular elements, each tubular element of said plurality of tubular elements provided with an axial bore having an open first end, an inside diameter, and a length at least four times as great as the inside diameter, the elements being affixed to one another in low resistance communication, with the bores parallel to one another, the inside diameter of each bore being dimensioned for ready entry therein of one conductor of said plurality of conductors, the assembly having a first edge defining the open first ends of the bores and a second, opposed edge, the second edge having an outside diameter small enough to fit into said passage of said wire nut at an open end thereof and being larger than the smaller diameter of the tapered internal thread such that said tubular elements are constructed to compress and crimp onto said plurality of conductors held therein when said wire nut is screwed onto the assembly, thereby electrically connecting said plurality of conductors.

2. The tube assembly according to claim 1, in which said each tubular elements is provided with an outer surface and a slot parallel to the axial bore extending from the bore to the outer surface.

3. The tube assembly according to claim 1, in which the number of said tubular elements is three.

4. The tube assembly according to claim 1, in which the number of said tubular elements is four.

5. The tube assembly according to claim 1, in which the number of said tubular elements is five.

6. The tube assembly according to claim 1, in which the number of said tubular elements is six.

7. A method of electrically joining the ends of a plurality of insulation clad conductors comprising the steps of:

a) providing a wire nut that has a rigid insulator structure having a channel defined therein and an open end and a conductive member received within the channel, the conductive member having a frusto-conical passage therein with a larger diameter of the passage facing the open end of the channel, the passage being provided with a tapered internal thread that has a smaller diameter facing the closed end;

b) providing a tube assembly comprising: a plurality of electrically conductive, crimpable tubular elements, each tubular element of said plurality of tubular elements provided with an axial bore having an open first end, an inside diameter, and a length at least four times as great as the inside diameter, the elements being affixed to one another in low resistance communication, with the bores parallel to one another, the inside diameter of each bore being dimensioned for ready entry therein of one conductor of said plurality of conductors, the assembly having a first edge defining the open first ends of the bores and a second, opposed edge, the second edge having an outside diameter small enough to fit into said passage of said wire nut at an open end thereof and being larger than the smaller diameter of the tapered internal thread such that said tubular elements are constructed to compress and crimp onto said plurality of conductors held therein when said wire nut is screwed onto the assembly, thereby electrically connecting said plurality of conductors;

c) stripping insulation from a conductor end of each conductor of said plurality of conductors;

d) inserting the insulation stripped conductor end of said each conductor into said each tubular element at the first end thereof;

e) inserting the second edge of said tube assembly into said frusto-conical passage; and f) rotating said wire nut relative to said plurality of conductors to draw said tube assembly into said tapered thread until said smaller diameter of said thread compresses and crimps said tubular elements onto said plurality of conductors thereby electrically joining together said plurality of conductors.

8. The tube assembly according to claim 1, in which said each tubular element is provided with an outer surface and a slot parallel to the axial bore extending from the bore to the outer surface.

9. The tube assembly according to claim 1, in which the number of said tubular elements is three.

10. The tube assembly according to claim 1, in which the number of said tubular elements is four.

11. The tube assembly according to claim 1, in which the number of said tubular elements is five.

12. The tube assembly according to claim 1, in which the number of said tubular elements is six.

13. In a solderless connector with a twist on wire nut having a rigid insulator structure with a channel defined therein and an open end, a conductive member received within the channel, the conductive member having a frusto-conical passage therein with a larger inside diameter of the passage facing the open end of the channel and a smaller inside diameter at the closed end, the passage being provided with a tapered internal screw thread for acting as a metal working surface for engaging and drawing wires into the passage by relative rotation therebetween, wherein the improvement comprises:

a plurality of electrically conductive, crimpable tubular elements, each tubular element of said plurality of tubular elements provided with an axial bore having an open first end, an inside diameter, and a length at least four times as great as the inside diameter, the elements being affixed to one another in low resistance communication, with the bores parallel to one another, the inside diameter of each bore being dimensioned for ready entry therein of one conductor of said plurality of conductors, the assembly having a first edge defining the open first ends of the bores and a second, opposed edge, the second edge having an outside diameter small enough to fit into said passage of said wire nut at an open end thereof and being larger than the smaller diameter of the tapered internal thread such that said tubular elements are constructed to compress and crimp onto said plurality of conductors held therein when said wire nut is screwed onto the assembly, thereby electrically connecting said plurality of conductors and in which said tubular elements are adapted to be at least partially cut through by said internal thread.

* * * * *